United States Patent [19]

Freedman

[11] 4,045,918

[45] Sept. 6, 1977

[54] ABRADING AND POLISHING TUMBLER APPARATUS

[75] Inventor: Robert Nathan Freedman, Great Neck, N.Y.

[73] Assignee: Natural Science Industries, Ltd., Far Rockaway, N.Y.

[21] Appl. No.: 651,868

[22] Filed: Jan. 23, 1976

[51] Int. Cl.[2] ..... B24B 31/02

[52] U.S. Cl. ..... 51/164; 259/81 R

[58] Field of Search ..... 51/7, 163.1, 164; 259/81 R

[56] References Cited

U.S. PATENT DOCUMENTS

| | | | |
|---|---|---|---|
| 401,228 | 4/1889 | Tiemann | 259/81 R |
| 1,301,070 | 4/1919 | Maddox | 259/81 R |
| 2,376,106 | 5/1945 | Witthofft | 51/164 X |
| 3,579,921 | 5/1971 | Bobo | 51/164 |
| 3,765,131 | 10/1973 | Christensen | 51/164 |

FOREIGN PATENT DOCUMENTS

| | | | |
|---|---|---|---|
| 192,359 | 11/1907 | Germany | 259/81 R |

*Primary Examiner*—Harold D. Whitehead
*Attorney, Agent, or Firm*—Wolder & Gross

[57] ABSTRACT

An abrading and polishing tumbler apparatus in which the tumbler barrel is concurrently rotated and rocked includes an internally ribbed barrel having a separable closure cap at one end with a peripheral friction face and a closed opposite end face provided with a medial longitudinal projection having a pair of transversely spaced first and second longitudinal bores, respectively, concentric with and eccentric to the barrel central axis. A pivot pin is fitted in a selected bore. A support frame carries an upwardly directed raised open topped saddle bearing and a friction wheel is rotatably mounted to the frame below and longitudinally spaced from the saddle bearing. The cap friction surface rests on the friction wheel and the pivot pin rests on a saddle bearing. The friction wheel is rotated by a frame mounted motor to only rotate the barrel when the pivot pin engages the concentric bore and rocks and rotates the barrel when the pivot pin engages the eccentric bore.

16 Claims, 5 Drawing Figures

ABRADING AND POLISHING TUMBLER APPARATUS

BACKGROUND OF THE INVENTION

The present invention relates generally to improvements in abrading and polishing apparatus and it relates more particularly to an improved tumbling apparatus which is highly useful in the abrading, polishing and finishing of stones, minerals and similar materials.

A common procedure in the abrading, polishing and finishing of irregularly shaped objects, for example, stones and minerals in lapidary practice, both professional and amateur, is to tumble the objects with a suitable abrasive composition in the barrel of a tumbling apparatus. The conventional tumbling apparatus in which the tumbler barrel generally rotates only about its central longitudinal axis possesses numerous drawbacks and disadvantages. They are highly inefficient and uneconomical in operation and are very highly time consuming in achieving a suitable amount of abrasion and polish. It has been found that the rate of abrasion is sharply increased by imparting to the rotating tumbler barrel a rocking action about a transverse axis. While such rocking action is highly desirable, however, the mechanisms heretofore available for achieving such rocking actions are complex, expensive, highly power consuming and tumbling apparatus employing such mechanisms are difficult and inconvenient to load and unload, are of low power efficiency and otherwise leave much to be desired.

SUMMARY OF THE INVENTION

It is a principal object of the present invention to provide an improved apparatus for abrading, polishing and finishing irregular objects.

Another object of the present invention is to provide an improved tumbling apparatus.

Still another object of the present invention is to provide an improved tumbling apparatus for the abrading, polishing and finishing of stones, minerals and the like in the field of lapidary practices both professional and amateur.

A further object of the present invention is to provide an apparatus of the above nature characterized by its reliability, simplicity, ruggedness, high efficiency, low cost, ease and convenience of application and great versatility and adaptability.

The above and other objects of the present invention will become apparent from a reading of the following description taken in conjunction with the accompanying drawings which illustrate a preferred embodiment thereof.

In a sense, the present invention contemplates the provision of a tumbling apparatus which is highly useful in the abrading, polishing and finishing of stones, minerals and other objects and comprises a tumbling barrel, a bearing for supporting one end of the barrel for rotation about its longitudinal axis and for rocking about a transverse axis, the axis extending through the bearing, and drive means for simultaneously rotating and rocking the tumbling barrel about the longitudinal and transverse axes, respectively.

According to a preferred form of the present apparatus, there is provided a mounting frame including a horizontal wall having a rectangular opening with longitudinally spaced transverse edges and the bearing is formed with the frame and is of semi-circular saddle shape and open topped and medially located above one of the opening transverse edges. A drive motor is housed in the frame and drives a longitudinal shaft journalled to the frame below the opening by means of a belt and pulley speed reducer. A friction wheel defining elastomeric sleeve is carried by the shaft below the opening of the other transverse edge. The tumbling barrel includes an internally ribbed cylindrical body member open at one end and closed by a wall at the opposite end, the open end of the barrel being separably engaged by a closure cap having a peripheral friction drive surface. The barrel end wall has a central projection provided with a pair of transversely spaced longitudinal bores, one of which is eccentric to and the other of which is concentric with the barrel central longitudinal axis. A pivot pin separably engages a selected end wall bore and in operative condition, the barrel registers with the frame opening with the pivot pin resting in the saddle bearing and the cap friction surface resting on the friction drive wheel. When the pivot pin engages the eccentric bore, rotation of the friction drive wheel rotates and rocks the tumbling barrel and when the pivot pin engages the concentric bore rotation of the friction wheel only rotates the barrel.

The improved tumbling apparatus achieves a highly desirable motion, both rocking and rotating the tumbler barrel and selectively only rotating the tumbler barrel, and is simple, inexpensive and rugged, and easy and convenient to use. It is highly efficient and economical and of great versatility and adaptability.

DESCRIPTION OF THE PREFERRED EMBODIMENT

Figures 1, 2, 3:
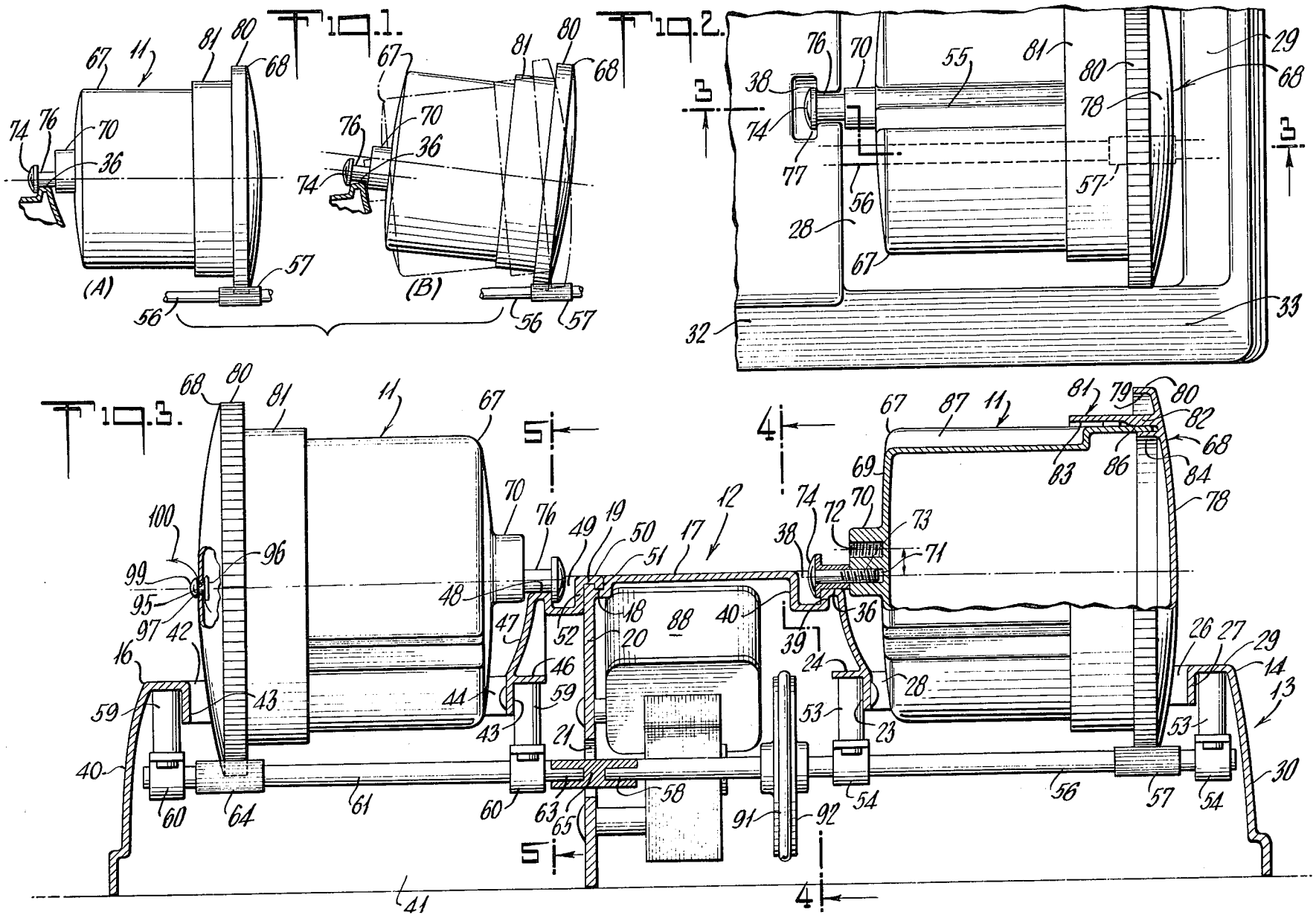
FIG. 1 are fragmentary front elevational view of the tumbler barrel and drive section of the improved apparatus showing two different modes of operation.
FIG. 2 is a fragmentary top plan view of the improved apparatus.
FIG. 3 is a sectional view taken along line 3—3 in FIG. 2.
Figure 4:
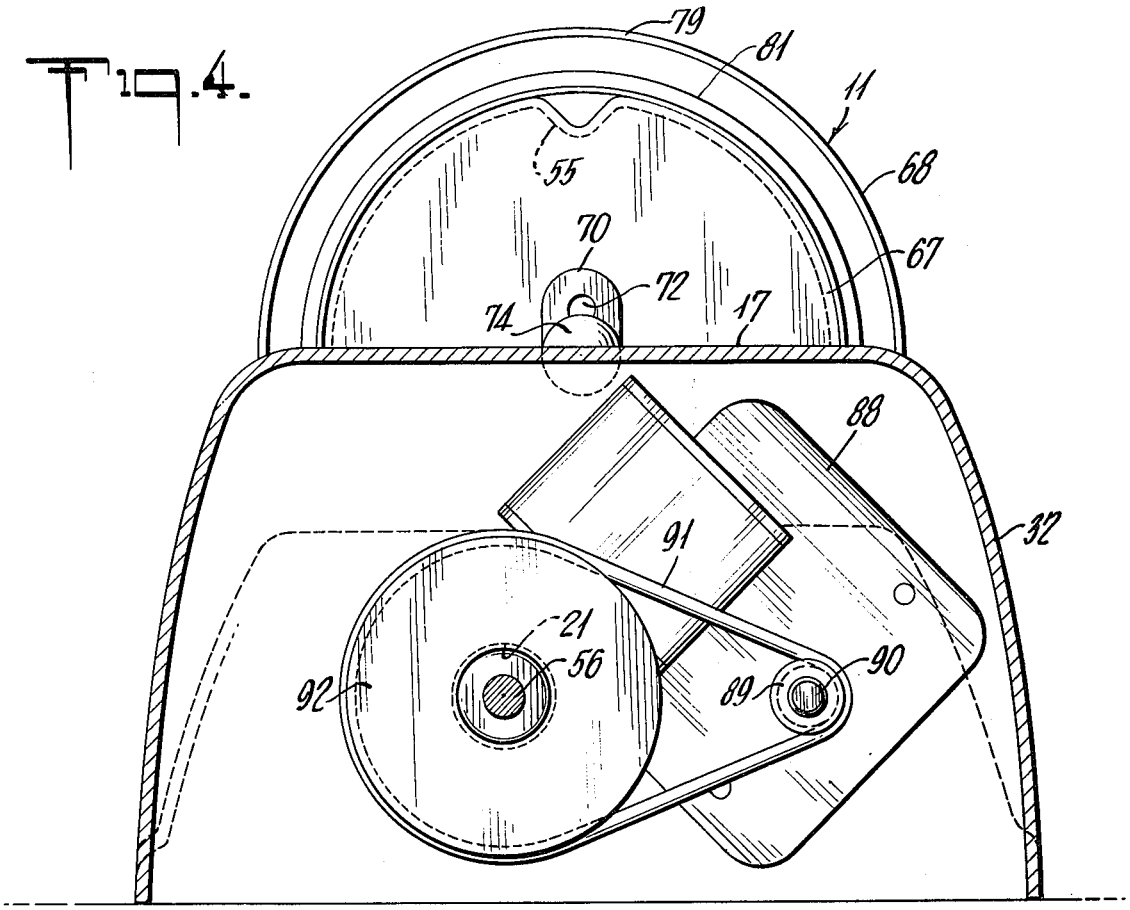
FIG. 4 is a sectional view taken along line 4—4 in FIG. 3.
Figure 5:
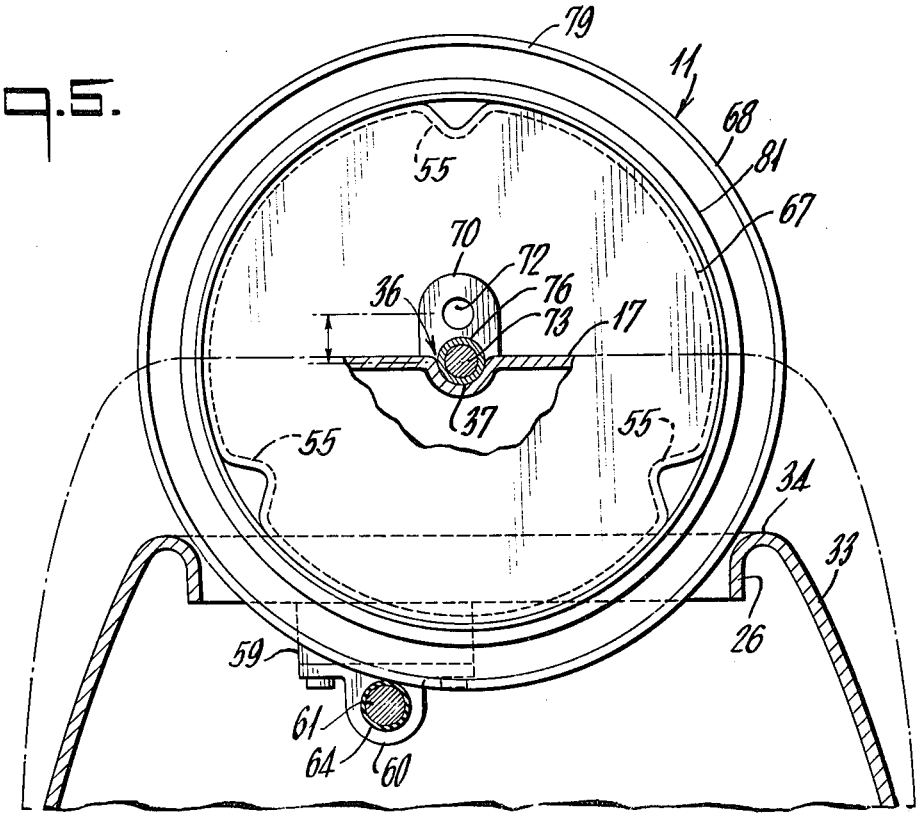
FIG. 5 is a sectional view taken along line 5—5 in FIG. 3.

Referring now to the drawings which illustrate a preferred embodiment of the present invention, the reference numeral 10 generally designates the improved tumbling apparatus which includes one or more tumbler barrels 11 of similar construction, the apparatus 10 being shown with two barrels 11 by way of example, and a drive section 12.

The drive section 12 comprises a support frame 13 which is divided into a main frame 14 and an auxiliary frame 16, the frames 14 and 16 being end-to-end separably coupled. The main frame 14 includes an inner or rear electric motor housing portion and an outer barrel and drive accommodating portion and is advantageously an integral unit formed of any suitable material. The top of the motor housing portion is defined by a raised inner top wall 17 which terminates at its inner end in a transversely extending coupling channel 18 provided with a foreshortened end leg 19 which extends upwardly to a point below the top of wall 17 and joins a coplanar vertical depending end wall 20 having formed above the bottom thereof an opening 21 transversely offset from the end wall vertical medial axis.

Depending and slightly forwardly inclined from the front edge of top wall 17 is a skirt wall which terminates in a depending transverse vertical flange 23 and a rearwardly directed horizontal flange 24. Extending horizontally forwardly from the side ends of flange 23 are parallel vertical side flanges 26 whose front ends are joined by a transversely extending vertical end flange 27, the flanges 23, 26 and 27 delineating a tumbling barrel receiving opening or window 28. Directed forwardly from the upper edge of flange 27 is a narrow horizontal flange 29 which terminates along its front edge in a forwardly downwardly inclined depending end wall 30. Downwardly outwardly inclined outwardly convex side walls 32 and 33 depend from the side edges of top wall 17 and from the outwardly extending upwardly convex outer top edges 34 of flanges 26 and are gradually joined at their proximate ends, the bottom edges of walls 20, 30, 32 and 33 lying in a common horizontal plane.

An open topped semi-cylindrical saddle bearing 36 is medially formed proximate the upper junction of walls 17 and 22 and includes a bearing defining upwardly convex semi-cylindrical wall section 37 formed in the front border of top wall 17 and open at opposite ends and the top thereof. A well 38 is formed in top wall 17 directly rearwardly of bearings 36 and of greater depth than the bearing and is delineated by a front wall 39 depending from the rear edge of wall section 37, a vertical rear wall and vertical side walls spaced a distance greater than the width of bearing 36 and a horizontal bottom wall.

The auxiliary frame 16 except for the omission of the motor housing section and the substitution of a coupling portion for the end wall 20 is substantially similar in construction to the main frame 14. Specifically, the frame 16 includes end and side walls 40 and 41 corresponding to end and side walls 30 and 33, a barrel receiving opening 42 corresponding to opening 28 and delineated by end and side flanges 43 and 44, the front end flange 43 joining along its top edge a forwardly directed transverse horizontal flange 46 and an upwardly projecting wall 47. An open topped semi-cylindrical saddle bearing 48, similar to saddle bearing 36, is medially formed along the top of wall 47 and is backed by a transversely extending top wall 50 which extends for the width of frame 16 and is coextensive in width with wall 17, the wall 50 projecting forwardly from the top edge of wall 47 shortly beyond the front wall of well 49 and terminating in a depending coupling tongue 51 which engages the coupling channel 18 and the channel end leg 19 being entrapped between the tongue 51 and the front wall 52 of channel 49.

Suitably mounted hanger members 53 located along the outside faces of opening transverse flanges 23 and 27 support depending bearing blocks 54 in longitudinal coaxial alignment with end wall transversely offset opening 21. A longitudinal shaft 56 is journalled in the bearing blocks 56 and extends to a point shortly forwardly of opening 21. A friction wheel defining elastomeric sleeve 57 formed of natural or artificial rubber is fitted on shaft 56 in vertical registry with and below the front border of opening 28 and is rotatable with shaft 56 and a large pulley 57 is affixed to the shaft 56 shortly rearwardly of rearmost bearing block 54. The rear end of shaft 56 terminates in a semi-cylindrical coupling stub 58.

In the auxiliary frame 16, a pair of suitably mounted hanger members 59 located along the outside faces of opening transverse flanges 43 support depending bearing block 60 in axial alignment with bearing blocks 54. A longitudinal shaft 61 is journalled in bearing blocks 60 and terminates at its forward end, forward of front bearing block 60 in a semi-cylindrical coupling stub 63. An elastomeric friction wheel defining sleeve 64, similar to sleeve 57 is fitted on and rotatable with shaft 61 below and forwardly of the rear border of opening 42. A separable drive coupling 65 has end coupling sockets matingly engaging respective stubs 58 and 63 to interconnect the shafts 56 and 61 when the frames 14 and 16 are intercoupled, as shown in the drawings. The frames 14 and 16 may be detached from each other by uncoupling channel 18 from tongue 51 and separating the coupling member 65 from stubs 58 and 63.

The tumbler barrels 11 are formed of any suitable material and each includes a body member 67 and a removable closure cap 68. The body member 67 is of hollow cylindrical configuration open at one end and closed at the opposite end by a slightly outwardly convexent wall 69. A plurality of peripherally spaced radially inwardly directed longitudinal ribs 55 are formed on the inner peripheral face of body member 67 and extend from end wall 69 to points short of the open end of body member 67.

Integrally formed with the end wall 69 and longitudinally projecting therefrom is a transversely extending hub or boss 70 having formed therein a pair of radially spaced trapped bores 71 and 72, the first bore 71 being coaxial with the central longitudinal axis of body member 67 and the second bore 72 being transversely offset and eccentric to such central longitudinal axis. A pivot pin defining elongated screw 73 having an enlarged head 74 releasably engages a selected of the tapped bores 71 and 72 and engages a bearing sleeve 76 having an outer peripheral flange 77 adjacent to the screw head 74, the sleeve 76 being entrapped between the screw head 74 the confronting face of boss 70. Each of the screw engaged sleeves 76 is cradled and nests in a corresponding saddle bearing 36 or 48 with the flange 77 abutting the inner face thereof, the sleeves and the engaging screws being rotatable in the saddle bearing about a longitudinal axis and rockable about a transverse axis.

The removable sealing closure cap 69 comprises an outwardly convex circular end wall 78 of greater diameter than body member 67 and provided with a rearwardly directed outer peripheral flange 79 having a finely longitudinally ribbed or knurled outer face 80 which defines a friction drive face. Also directed rearwardly from and integrally formed with the rear face of end wall 78 and coaxial therewith is a cylindrical skirt wall 81 having a short inner section 82 of greater thickness and lesser inside diameter than the longer outer section 83. A circular cylindrical lip or flange 84 also projects coaxially rearwardly from end wall 78 and delineates with the wall inner section 82 an annular channel which tightly releasably engages the border 86 of the free end of the peripheral wall 87 of barrel body member 67. Thus, the cap member 68 tightly closes the barrel body member open end, suitable means advantageously being provided to afford a hermetic seal, and may be selectively separated from the body member 67 to open the barrel for the insertion or removal of work pieces and abrading composition.

In the operable condition of the improved apparatus 10, the screw carried sleeve 76 rests in a cradle bearing 36 or 48 and the friction surface 80 of a corresponding flange 79 rests on and is in frictional drive engagement with a respective friction sleeve 57 or 64 with the barrel 11 depending below the registering opening in the support frame. A transversely offset low speed drive motor 88 which may be connected to a suitable source of current by way of an associated power cord and, preferably, hand actuated switch is mounted on end wall 20 within main frame 14 by means of suitable screws and spacers. A small pulley 89 is affixed to the shaft 90 by motor 88 and is coupled to pulley 57 by a drive belt 91 so that the friction wheels 57 and 64 are positively driven and slowly rotate the barrels 11 by way of their friction drive surfaces 80.

When the pivot pin screw engages the concentric end bore 71, as shown in FIG. 1, arrangement (A), rotation of friction wheel 57 rotates the barrel about its central axis but does not rock the barrel, the surface 80 remaining coaxial with a horizontal axis and the pivot sleeve 76 and the cradle bearing. On the other hand, when the pivot pin screw engages the eccentric bore 72, as shown in FIG. 1, arrangement (B), rotation of the friction wheel 57 both rotates the barrel about a longitudinally extending axis passing through the saddle bearing and rocks the barrel about a transverse axis passing through the saddle bearing between downwardly and upwardly forwardly inclined positions, as shown by the solid and broken lines, respectively. Advantageously, the surface of friction wheel 57 engaging barrel friction drive surface 80 is transversely spaced from the central longitudinal axis of barrel 11 passing through the central axis of the saddle bearing a distance about equal to the radius of friction drive surface 80.

The application and operation of the improved apparatus 10 are clear from the above. The barrel 11 may be selectively adjusted to only rotate or to simultaneously rock and rotate depending on the rate of abrasion desired.

As an additional optional feature of the invention, referring to the tumbler barrel 11 shown in the lefthand portion of FIG. 3, there may appear a hole 95 in the end wal1 78 in alignment with the central axis of the barrel. Into this opening may be fitted a plug 96 haviung an expanded inner engaging portion 97 whose upper surface abuts the inner surface of the wall 78, a neck portion 98 and an expanded upper beaded portion 99 whose lower surface abuts a very small portion of the outer surface of the end wall 78. The plug fits snugly within the hole but there is sufficient clearance between the neck 98 and the inner diameter of the hole 95 so that the plug acts as a self-degassing unit. During the course of the tumbling gases build up in the tumbler barrel and they may pass outwardly between the upper surface of expanded inner engaging portion 97 and the inner surface of the end wall 78, then between the neck 98 and the hole 95, and then passing outwardly by the lower inner surface of bead 98 and the outer surface of the wall 78 as illustrated by the arrow 100.

While there has been described and illustrated a preferred embodiment of the present invention, it is apparent that numerous alterations, omissions and additions may be made without departing from the spirit thereof.

I claim:

1. A tumbling apparatus comprising a tumbling barrel, bearing means for supporting a first end section of said barrel for free rotation of said barrel about a longitudinally extending axis and for free rocking of said barrel about a transversely extending axis and engaging said barrel first end section at selectively transferable alternative points respectively concentric and eccentric to the central longitudinal axis of said barrel, said axes of rotation and rocking extending substantially through said bearing means, and drive means for simultaneously rotating and rocking said tumbling barrel about said longitudinally extending and transverse axes, respectively, when said bearing means engages said first end section at said eccentric point.

2. The tumbling apparatus of claim 1 wherein said tumbling barrel includes a first end face and said bearing means rotationally and rockably engages said barrel first end face at a point alternatively to and concentric with the central longitudinal axis of said barrel.

3. The tumbling apparatus of claim 2 wherein said bearing means includes a saddle shaped bearing and a pivot member extending longitudinally from said barrel first end face at a point alternatively selectively eccentric to and concentric with the central longitudinal axis of said barrel and resting in said bearing and being transversely movable therein.

4. The tumbling apparatus of claim 1 wherein said drive means comprises a circular driven section located on said barrel remote from said first end section, a rotatable drive member engaging said circular driven section and motor means driving said drive member.

5. The tumbling apparatus of claim 4 wherein said circular driven section is disposed along the periphery of said barrel and rests on said rotatable drive member.

6. The tumbling apparatus of claim 5 wherein said tumbling barrel comprises a cylindrical body member having an open end remote from an end face defining said first end section and a cap member separably engaging said body member open end and having a cylindrical skirt wall defining said circular driven section.

7. A tumbling apparatus comprising a support frame, an upwardly directed saddle bearing located on said support frame, an electric motor mounted on said support frame, a friction drive wheel coupled to said drive motor and supported for rotation about an axis below and parallel to the axis of said saddle bearing, a longitudinally extending tumbler barrel including a body portion having a closed end face and open at its opposite end and a closure cap separably engaging said body portion open end and having an outer peripheral friction drive surface engaging said friction drive wheel and a pivot pin extending longitudinally from said barrel body portion end face and selectively transferable between points thereon alternatively eccentric to and concentric with the central longitudinal axis of said barrel and resting on said saddle bearing.

8. The tumbling apparatus of claim 7 wherein said support frame includes an upper wall having an opening therein having opposite longitudinally spaced first and second edges, said saddle bearing being disposed proximate and above said opening first edge and said friction wheel being disposed proximate and below said opening second edge, said tumbler barrel registering with said opening and the outer peripheral drive surface of said cap resting on said friction wheel.

9. The tumbling apparatus of claim 7 wherein said body member end face has a medially disposed longitudinally outwardly directed boss formed therein, said boss having a pair of transversely spaced longitudinal bores, one of said bores being coaxial with said barrel central longitudinal aixs and the other of said bores being eccentric to said axis, said pivot pin separably engaging a preselected bore.

10. The tumbling apparatus of claim 7 including a pair of longitudinally spaced bearings mounted on said frame below said frame opening, a shaft extending between and journaled in spaced bearings, an elastomeric sleeve defining said friction drive wheel engaging said shaft, said closure cap peripheral surface resting on said sleeve, and a speed reducing transmission coupling said motor to said shaft.

11. The tumbling apparatus of claim 7 wherein said barrel body member has peripherally spaced longitudinally extending inwardly directed ribs formed on the inside face thereof.

12. The tumbling apparatus of claim 7 including a second support frame coupled in end-to-end relationship to the first support frame, an upwardly directed second saddle bearing located on said second support frame, a second drive wheel coupled to said drive motor and supported for rotation about an axis below and parallel to the axis of said second saddle bearing, a longitudinally extending second tumbler frame including a second body portion having a closed end face and open at its opposite end and a second closure cap separably engaging said second body portion open end and having an outer peripheral friction drive surface engaging said second friction drive wheel and a second pivot pin extending longitudinally from said barrel body portion end face and resting on said second saddle bearing.

13. The tumbling apparatus of claim 1 wherein said tumbling barrel has a self-degassing means thereon.

14. The tumbling apparatus of claim 7 wherein said tumbling barrel has a self-degassing means thereon.

15. The tumbling apparatus of claim 13 wherein the degassing means includes a plug and the end wall of the tumbling barrel has an opening therein to receive said plug in a snug, non-gas, impervious fit.

16. The tumbling apparatus of claim 14 wherein the degassing means includes a plug and the end wall of the tumbling barrel has an opening therein to receive said plyg in a snug, non-gas, impervious fit.

* * * * *